US008622228B2

(12) United States Patent
Mentink et al.

(10) Patent No.: US 8,622,228 B2
(45) Date of Patent: Jan. 7, 2014

(54) BOOM HOIST TRANSPORTATION SYSTEM AND CRANE USING SAME

(75) Inventors: Trevor D. Mentink, Oostburg, WI (US); Robert J. Walker, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 346 days.

(21) Appl. No.: 12/561,007

(22) Filed: Sep. 16, 2009

(65) Prior Publication Data

US 2010/0072156 A1 Mar. 25, 2010

Related U.S. Application Data

(60) Provisional application No. 61/098,632, filed on Sep. 19, 2008.

(51) Int. Cl.
*B66C 23/18* (2006.01)

(52) U.S. Cl.
USPC ..... 212/179

(58) Field of Classification Search
USPC ..... 212/181, 180, 179, 175, 294, 298–300, 212/255, 260, 262, 223, 232, 239, 271, 71
See application file for complete search history.

(56) References Cited

U.S. PATENT DOCUMENTS

| | | | | |
|---|---|---|---|---|
| 3,977,530 | A * | 8/1976 | Helm et al. | 212/175 |
| 4,421,241 | A * | 12/1983 | Wittman et al. | 212/298 |
| 4,557,391 | A | 12/1985 | Poock et al. | |
| 5,427,256 | A | 6/1995 | Kleppe | |
| 5,443,169 | A | 8/1995 | Pagel et al. | |
| 5,484,069 | A | 1/1996 | Lanning | |
| 5,960,970 | A | 10/1999 | Walker | |
| 7,565,982 | B2 * | 7/2009 | Kurotsu et al. | 212/298 |
| 2007/0256999 | A1 | 11/2007 | Kurotsu et al. | |
| 2008/0264887 | A1 | 10/2008 | Porubcansky | |

FOREIGN PATENT DOCUMENTS

| | | | |
|---|---|---|---|
| EP | 1854759 | A2 | 11/2007 |
| EP | 1927571 | A2 | 6/2008 |

* cited by examiner

*Primary Examiner* — Sang Kim
*Assistant Examiner* — Juan Campos, Jr.
(74) *Attorney, Agent, or Firm* — Steven P. Shurtz; Brinks Gilson & Lione

(57) ABSTRACT

A mobile lift crane includes a boom pivotally mounted on a rotating bed and a boom hoist drum mounted in a frame connected to the rotating bed. A boom hoist line is wound on the boom hoist drum and connected to an upper equalizer and a lower equalizer, with the upper equalizer connected to the top of the boom, such that rotation of the boom hoist drum changes the amount of boom hoist line between the lower equalizer and the upper equalizer, thereby changing the angle between the rotating bed and the boom. The boom hoist drum frame, the lower equalizer and the upper equalizer each include cooperating attachment structures whereby the equalizers can be detachably connected to the frame so that the boom hoist drum, the lower equalizer, the upper equalizer and the boom hoist line can be transported between job sites as a combined assembly.

18 Claims, 14 Drawing Sheets

BOOM HOIST TRANSPORTATION SYSTEM AND CRANE USING SAME

REFERENCE TO EARLIER FILED APPLICATIONS

The present application claims the benefit of the filing date under 35 U.S.C. §119(e) of Provisional U.S. Patent Application Ser. No. 61/098,632 filed Sep. 19, 2008; which is hereby incorporated by reference in its entirety.

BACKGROUND

The present invention relates to a mobile lifting crane that uses a boom hoist drum and rigging to change the angle of the boom. The invention provides a way to transport the boom hoist drum and rigging between job sites when the crane is disassembled for transport so that the boom hoist line does not have to be re-reeved when the crane is set up at the new job site.

Mobile lift cranes typically include a carbody having moveable ground engaging members; a rotating bed rotatably connected to the carbody such that the rotating bed can swing with respect to the ground engaging members; a boom pivotally mounted on a front portion of the rotating bed, with a load hoist line extending there from, and counterweight to help balance the crane when the crane lifts a load. There are different ways of changing the angle of the boom with respect to the rotating bed during crane operation, including using hydraulic cylinders mounted between the boom and the rotating bed. However, more commonly a boom hoist drum and rigging are used to change the boom angle. Many cranes also use a mast mounted on the rotating bed to support the rigging, including the boom hoist rigging, so that it may transfer the forces from lifting a load to the rear of the carbody and the counterweight. The boom hoist rigging must carry large tension loads, supporting not only the boom, but counteracting the angled force applied by the boom as it supports the load. The boom hoist rigging includes the boom hoist line extending from the boom hoist drum and reeved through a lower equalizer (which may be attached to the top of the mast), and an upper equalizer with multiple parts of line so that the large tension loads on the rigging are distributed over the multiple parts of line. The upper equalizer is usually connected to the boom top by fixed length pendants. The length of the pendants is chosen to correspond with the length of the boom.

Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner. If the boom hoist line can remain reeved through the lower and upper equalizers during the transportation operation, the line will not have to be re-reeved though the sheaves on the equalizers when the crane is set up again.

Several models of cranes have been designed to accomplish transporting the crane without unreeveing the boom hoist line. For example, U.S. Pat. No. 5,484,069 discloses a crane where the upper equalizer is disconnected from the boom top and connected to the mast (in this case the mast is part of a gantry) for transport. Since the gantry has the lower equalizer attached to it, and since the gantry does not need to be disconnected from the rotating bed, to which the boom hoist drum is attached, the boom hoist line does not need to be pulled out from the lower equalizer (mast top sheave assembly) and the upper equalizer during the disassembly process.

For some very large cranes, the size of the mast and the boom hoist drum are so large that they cannot both be transported on one truck. In that situation, the prior art practice has been to pull all of the boom hoist line onto the boom hoist drum so that it does not run through the sheaves on the mast top. The mast can then be disconnected from the rotating bed and transported separately. Unfortunately, this requires the boom hoist line to be reeved through the sheave assemblies in the lower and upper equalizers when the crane is set up again, a time consuming process. Thus it would be a great advantage if a system could be developed that allowed such very large cranes to be transported without having to pull the boom hoist line from the equalizers for transport.

BRIEF SUMMARY

The present invention includes a crane that has a boom hoist drum and rigging for changing the boom angle, and a system that allows the boom hoist line to remain reeved through the equalizers, even though the boom hoist drum is transported between job sites on a separate transport trailer from the mast and from the rotating bed. The invention also involves a method of disassembling and transporting a crane, and setting up a crane, utilizing the boom hoist transportation system.

In a first aspect, the invention is a mobile lift crane comprising a carbody having moveable ground engaging members; a rotating bed rotatably connected to the carbody such that the rotating bed can swing with respect to the ground engaging members; a boom pivotally mounted on the rotating bed; a load hoist line trained over a pulley on the boom and wound on a load hoist drum connected to the rotating bed; a boom hoist drum mounted in a frame, the frame being connected to the rotating bed; and a boom hoist line wound on the boom hoist drum and connected to an upper equalizer and a lower equalizer, with the upper equalizer connected to the top of the boom by fixed length pendants, such that rotation of the boom hoist drum changes the amount of boom hoist line between the lower equalizer and the upper equalizer, thereby changing the angle between the rotating bed and the boom; the boom hoist drum frame, the lower equalizer and the upper equalizer each including cooperating attachment structures whereby the lower and upper equalizers can be detachably connected to the frame so that the boom hoist drum, the lower equalizer, the upper equalizer and the boom hoist line can be transported as a combined assembly.

In a second aspect, the invention is a method of disassembling and transporting a mobile lift crane, the lift crane comprising, prior to disassembly, i) a rotating bed, ii) a boom pivotally mounted on the rotating bed, iii) a boom hoist drum mounted in a frame, the frame being connected to the rotating bed, iv) a lower equalizer connected to the rotating bed, v) an upper equalizer, vi) fixed length pendants connected between the upper equalizer and the boom top, and vii) a boom hoist line wound on the boom hoist drum and reeved through the lower equalizer and the upper equalizer such that rotation of the boom hoist drum changes the amount of boom hoist line between the lower equalizer and the upper equalizer, thereby changing the angle between the rotating bed and the boom; the method comprising: a) disconnecting the fixed length pendants from between the boom top and the upper equalizer; b) disconnecting the lower equalizer from the rotating bed; c) disconnecting the boom hoist drum frame from the rotating bed; d) leaving the boom hoist line reeved between the lower equalizer and the upper equalizer and wound on the boom hoist drum; e) connecting the lower equalizer, and preferably the upper equalizer as well to the boom hoist drum frame; and f) transporting the boom hoist drum, boom hoist drum frame, lower equalizer, upper equalizer and boom hoist line together on a single transport trailer between one job site and another.

In a third aspect, the invention is a method of disassembling a mobile lift crane, the lift crane comprising, prior to disassembly, i) a rotating bed, ii) a boom pivotally mounted on the rotating bed, iii) a boom hoist drum mounted in a frame, the frame being connected to the rotating bed, iv) a lower equalizer connected to the rotating bed, v) an upper equalizer, vi) fixed length pendants connected between the upper equalizer and the boom top, and vii) a boom hoist line wound on the boom hoist drum and reeved through the lower equalizer and the upper equalizer such that rotation of the boom hoist drum changes the amount of boom hoist line between the lower equalizer and the upper equalizer, thereby changing the angle between the rotating bed and the boom; the method comprising: a) disconnecting the fixed length pendants from between the boom top and the upper equalizer; b) disconnecting the lower equalizer from the rotating bed; c) disconnecting the boom hoist drum frame from the rotating bed; d) leaving the boom hoist line reeved between the lower equalizer and the upper equalizer and wound on the boom hoist drum; and e) connecting the lower equalizer and upper equalizer to the boom hoist drum frame to form a combined transport assembly.

In a fourth aspect, the invention is method of setting up a mobile lift crane, comprising providing a carbody having moveable ground engaging members, and a rotating bed rotatably connected to the carbody such that the rotating bed can swing with respect to the ground engaging members; providing a combination of a boom hoist drum secured to a frame, a first equalizer having a plurality of sheaves, a second equalizer having a plurality of sheaves, and a boom hoist line, wherein the first equalizer is detachably connected to the boom hoist drum frame, the second equalizer is also detachably connected to the boom hoist drum frame, and the boom hoist line is wound on the boom hoist drum and reeved between the sheaves of the first and second equalizers; connecting the combined boom hoist drum, frame and equalizers to the rotating bed; disconnecting the first and second equalizers from the boom hoist drum frame while leaving the boom hoist line reeved between the pluralities of sheaves; connecting the first equalizer to the rotating bed; pivotally connecting a boom having a boom top to the rotating bed; and connecting the second equalizer to the boom top with fixed length pendants.

In a fifth aspect, the invention is a combination of a boom hoist drum secured to a frame, a first equalizer having a plurality of sheaves, a second equalizer having a plurality of sheaves, and a boom hoist line, wherein the first equalizer is detachably connected to the boom hoist drum frame, the second equalizer is also detachably connected to the boom hoist drum frame, and the boom hoist line is wound on the boom hoist drum and reeved between the sheaves of the first and second equalizers.

By mounting the boom hoist drum in a frame to which the lower and upper equalizers can each be attached, and using a lower equalizer that can be disconnected from the mast, the boom hoist line can remain reeved though the sheaves of the equalizers and wound on the boom hoist drum, and the entire combination can be transported as a single unit. With the proper set-up steps, this package can then be installed on the rotating bed as the crane is being reassembled, and the equalizers disconnected from the boom hoist frame and connected at the appropriate time and places to the other crane components. Not only does the boom hoist line not need to be re-reeved upon set up, but the boom hoist rigging is transported in a neat package that prevents the boom hoist line from tangling with itself or other crane components during the disassemble, transport and reassembly procedure. These and other advantages of the invention, as well as the invention itself, will be more easily understood in view of the attached drawings.

DETAILED DESCRIPTION OF THE DRAWINGS AND THE PRESENTLY PREFERRED EMBODIMENTS

Figure 1:
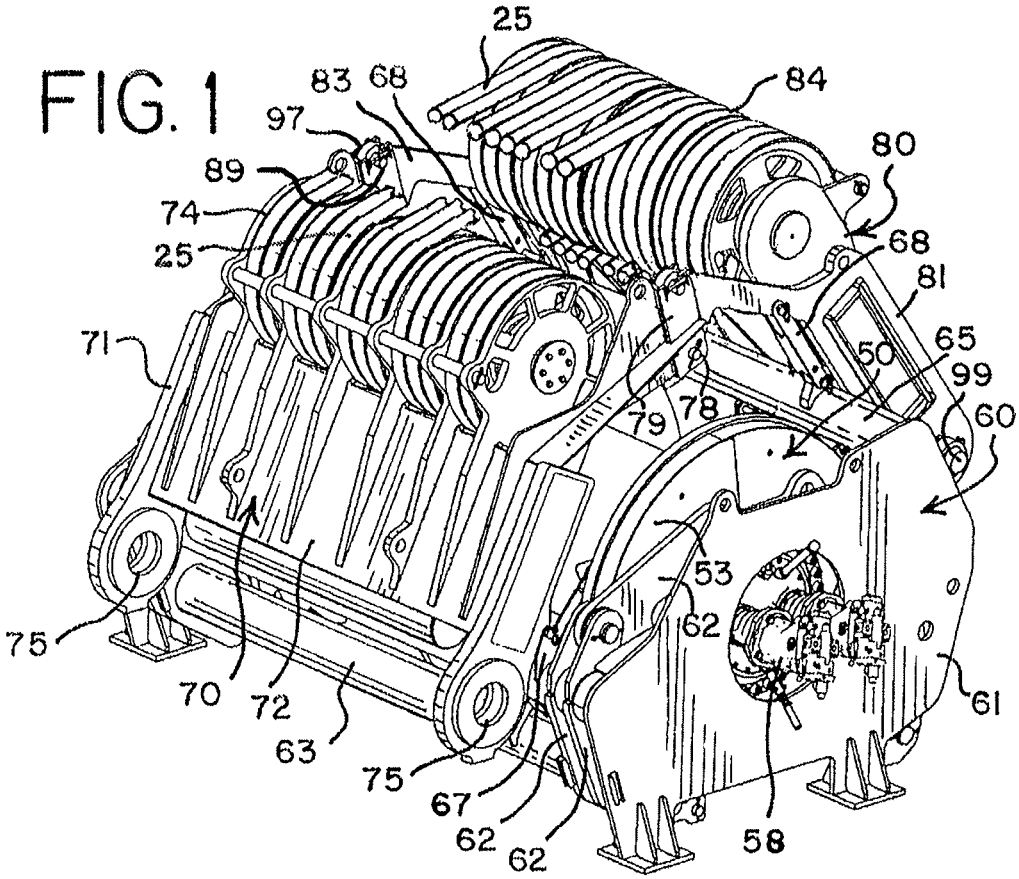
FIG. 1 is a perspective view of a preferred combined boom hoist drum, frame, upper equalizer and lower equalizer of the present invention, connected together in their transport configuration. Only a portion of the boom hoist line is shown, for sake of clarity.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present invention relates to a high capacity mobile lift crane, other aspects of which are disclosed in U.S. Pat. No. 7,546,928 and the following co-pending United States patent applications assigned to the assignee of the present application: "Mobile Lift Crane With Variable Position Counterweight," Ser. No. 12/023,902, filed Jan. 31, 2008, "Mast Raising Structure And Process For High-Capacity Mobile Lift Crane," Ser. No. 11/740,726, filed Apr. 26, 2007; "Trunnion Transportation System, Carbody Connection System And Crane Using Same," Ser. No. 61/099,098, filed Sep. 22, 2008; "Connection System For Crane Boom Segments," Ser. No. 12/273,310, filed Nov. 18, 2008; "Drive Tumbler And Track Drive For Mobile Vehicles, Including Lift Cranes," Ser. No. 12/368,143, filed Feb. 9, 2009; "Track Connection System For Mobile Vehicles, Including Lift Cranes," Ser. No. 12/368,125, filed Feb. 9, 2009; "Track Tensioning System For Mobile Vehicles, Including Lift Cranes," Ser. No. 12/368,113, filed Feb. 9, 2009; "Crane Hook Block," Ser. No. 61/155,455, filed Feb. 25, 2009; "Carbody Connection System and Crane Using Same," Ser. No. 61/155,440, filed Feb. 25, 2009; "Counterweight Block And Assemblies For Cranes," Ser. No. 61/158,599, filed Mar. 9, 2009; "Swing Drive System For Cranes," Ser. No. 61/155,414, filed Feb. 25, 2009; "Drum Frame System For Cranes," Ser. No. 61/155,401, filed Feb. 25, 2009; "Folding Jib Main Strut And Transportable Reeved Strut Caps," Ser. No. 61/165,403, filed Mar. 31, 2009; "Crane Boom Stop," Ser. No. 61/179,935, filed May 20, 2009; and "Crane Backstay Spreader", Ser. No. 61/179,983, filed May 20, 2009. Each of these applications is hereby incorporated by reference.

Several terms used in the specification and claims have a meaning defined as follows.

The term "equalizer" designates an arrangement of sheaves secured together so as to act in concert in spreading tensional force between multiple parts of line. Equalizers are used in pairs. The term "upper equalizer" in a boom hoist rigging arrangement is used to refer to the equalizer closest to the boom top. The term "lower equalizer" is used to refer to the equalizer paired with the upper equalizer but furthest from the boom top. The "lower equalizer" is typically secured to a mast or gantry, and may be built into the mast or gantry top. This type of lower equalizer is often referred to as a mast top sheave assembly. Some cranes use a live mast, where a fixed length pendant is secured between the boom top and the live mast, and changes in the amount of boom hoist line directly change the angle of the live mast with respect to the rotating bed, which secondarily then changes the angle of the boom with respect to the rotating bed. In that instance the upper equalizer is secured to the top of the mast, and the lower equalizer is secured to the rotating bed at a lower point, such as on a gantry. See, for example, U.S. Patent Application Publication No. 2007/0256999. In that document, the embodiment of FIG. 2 has a guy line 44 between the boom top and the mast. In the context of the present definition, the mast side spreader 45 would be considered the upper equalizer, and the gantry side spreader 46 would be the lower equalizer.

The term "boom hoist drum" designates a winch used to take up and pay out line that is used to control the angle of the boom. The boom hoist drum includes a generally cylindrical body on which the boom hoist line is wound, as well as the mechanical and hydraulic controls for controlling rotation of the cylindrical body. Again, by way of example, in U.S. Patent Application Publication No. 2007/0256999, the hoisting winch 7, with its drum 7*a*, constitutes an example of a boom hoist drum.

The term "boom hoist drum frame" designates the structure that is used to hold the boom hoist drum components together, and to mount them to other crane components. Also, as in the present invention, other components may be mounted to the frame. However, the term "frame" is meant to designate structure that is reasonably close in size to the drum and used for the above enumerated purposes. Thus structure that is used as another major component of a crane, or that is more than twice as long as the cylindrical part of the drum, or more than twice the diameter of the drum, would not be considered part of a frame of the drum. Again, by way of example, in U.S. Patent Application Publication No. 2007/0256999, the brackets holding the shaft 7*b* constitute part of the frame. However, when the winch 7 is connected to the compressing member 42 as in FIG. 2, or attached to the frames that constitute mast 8 in FIGS. 1A and 1C, the compressing member 42 and the mast 8 are not part of the boom hoist drum frame.

Figure 20:
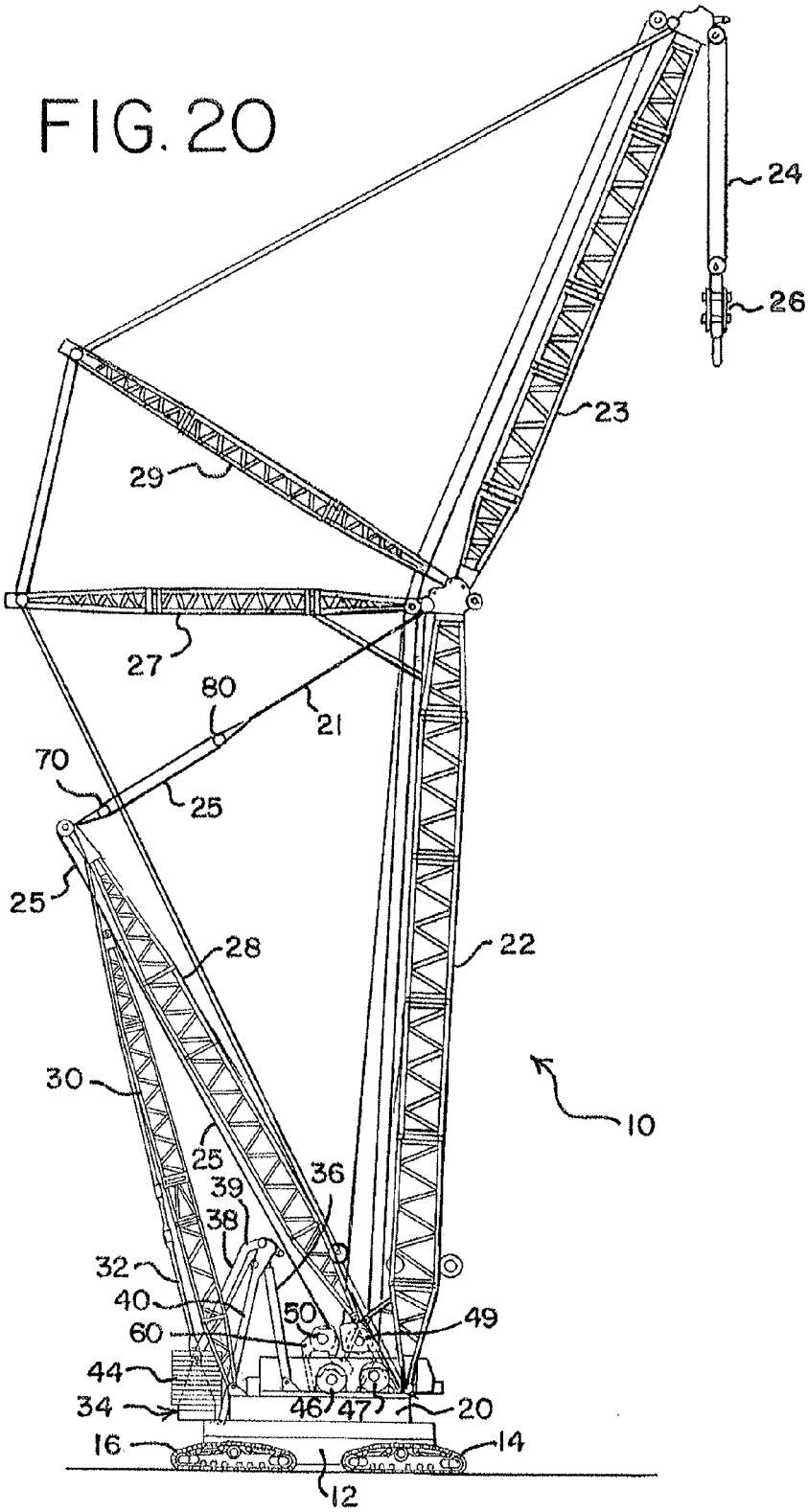
FIG. 20 is a side elevational view of the crane components as assembled in FIG. 19 with the crane fully assembled and in an operational position.

While the invention will have applicability to boom hoist systems used on other types of cranes, it will be described in connection with mobile lift crane 10, shown in an operational configuration in FIG. 20. The mobile lift crane 10 includes lower works, also referred to as a carbody 12, and moveable ground engaging members in the form of crawlers 14 and 16. There are of course two front crawlers 14 and two rear crawlers 16, only one each of which can be seen from the side view of FIG. 20. In the crane 10, the ground engaging members could be just one set of crawlers, one crawler on each side. Of course additional crawlers than those shown can be used, as well as other types of ground engaging members, such as tires.

A rotating bed 20 is rotatably connected to the carbody 12 such that the rotating bed can swing with respect to the ground engaging members. The rotating bed is mounted to the carbody 12 with a slewing ring, such that the rotating bed 20 can swing about an axis with respect to the ground engaging members 14, 16. The rotating bed supports a boom 22 pivotally mounted on a front portion of the rotating bed; a mast 28 mounted at its first end on the rotating bed, with a lower equalizer 70 connected to the mast adjacent the second end of the mast; a backhitch 30 connected between the mast and a rear portion of the rotating bed; and a moveable counterweight unit 34. The counterweight may be in the form of multiple stacks of individual counterweight members 44 on a support member.

Boom hoist rigging (described in more detail below) between the top of mast 28 and boom 22 is used to control the boom angle and transfer load so that the counterweight can be used to balance a load lifted by the crane. A load hoist line 24 is trained over a pulley on the boom 22, supporting a hook 26. At the other end, the load hoist line is wound on a load hoist drum connected to the rotating bed. The rotating bed 20 includes other elements commonly found on a mobile lift crane, such as an operator's cab and hoist drums for the boom hoist rigging and other hoist and whip lines. If desired, and as shown in FIG. 20, the boom 22 may comprise a luffing jib 23 pivotally mounted to the top of the main boom, or other boom configurations. When a luffing jib 23 is included, the crane may include first and second jib struts 27 and 29, as well as associated luffing jib rigging.

The backhitch 30 is connected adjacent the top of the mast 28, but down the mast far enough that it does not interfere with other items connected to the mast. The backhitch 30 may comprise a lattice member, as shown in FIG. 20, designed to carry both compression and tension loads. In the crane 10, the mast is held at a fixed angle with respect to the rotating bed during crane operations, such as a pick, move and set operation.

The counterweight unit 34 is moveable with respect to the rest of the rotating bed 20. A tension member 32 connected adjacent the top of the mast supports the counterweight unit in a suspended mode. A counterweight movement structure is connected between the rotating bed and the counterweight unit such that the counterweight unit may be moved to and held at a first position in front of the top of the mast, and moved to and held at a second position rearward of the top of the mast.

At least one linear actuation device 36, such as a hydraulic cylinder, or alternatively a rack and pinion assembly, and at least one arm pivotally connected at a first end to the rotating bed and at a second end to the a linear actuation device 36, are used in the counterweight movement structure of crane 10 to change the position of the counterweight. The arm and linear actuation device 36 are connected between the rotating bed and the counterweight unit such that extension and retraction of the linear actuation device 36 changes the position of the counterweight unit compared to the rotating bed. While FIG. 20 shows the counterweight unit in its most forward position, the linear actuation device 36 can be partially or fully extended, which moves the counterweight unit to mid and aft positions, or any intermediate position, such as when a load is suspended from the hook 26.

In the preferred embodiment of the counterweight movement structure, a pivot frame 40, which may be a solid welded plate structure, is connected between the rotating bed 20 and the second end of the linear actuation device 36. The rear arm 38 is connected between the pivot frame 40 and the counterweight unit. The rear arm 38 is also a welded plate structure with an angled portion 39 at the end that connects to the pivot frame 40. This allows the arm 38 to connect directly in line with the pivot frame 40. The backhitch 30 has an A-shape configuration, with spread apart lower legs, which allows the counterweight movement structure to pass between the legs when needed.

The crane 10 may be equipped with a counterweight support system (not shown), which may be required to comply with crane regulations in some countries. The counterweight movement structure and counterweight support structure are more fully disclosed in U.S. patent application Ser. No. 12/023,902, entitled "Mobile Lift Crane With Variable Position Counterweight," incorporated herein by reference.

The boom hoist rigging includes a boom hoist line in the form of wire rope 25 wound on a boom hoist drum 50, and reeved through sheaves on a lower equalizer 70 and an upper equalizer 80. The boom hoist drum is mounted in a frame 60 connected to the rotating bed. The rigging also includes fixed length pendants 21 connected between the boom top and the upper equalizer 80. The lower equalizer 70 is connected to the rotating bed 20 though the mast 28. This arrangement allows rotation of the boom hoist drum 50 to change the amount of boom hoist line 25 between the lower equalizer 70 and the upper equalizer 80, thereby changing the angle between the rotating bed 20 and the boom 22.

The boom hoist drum frame 60, the lower equalizer 70 and the upper equalizer 80 each include cooperating attachment structures whereby the lower and upper equalizers can be detachably connected to the frame so that the boom hoist drum, the lower equalizer, the upper equalizer and the boom hoist line can be transported as a combined assembly. The combined boom hoist drum 50, frame 60, lower equalizer 70 and upper equalizer 80, arranged as they would be for transportation between job sites, are shown in FIG. 1. This is a novel combination of a boom hoist drum secured to a frame, a first equalizer, a second equalizer, and a boom hoist line, wherein the first equalizer is detachably connected to the boom hoist drum frame, the second equalizer is also detachably connected to the boom hoist drum frame, and the line is wound on the boom hoist drum and reeved between the sheaves of the first and second equalizers.

Figure 2:
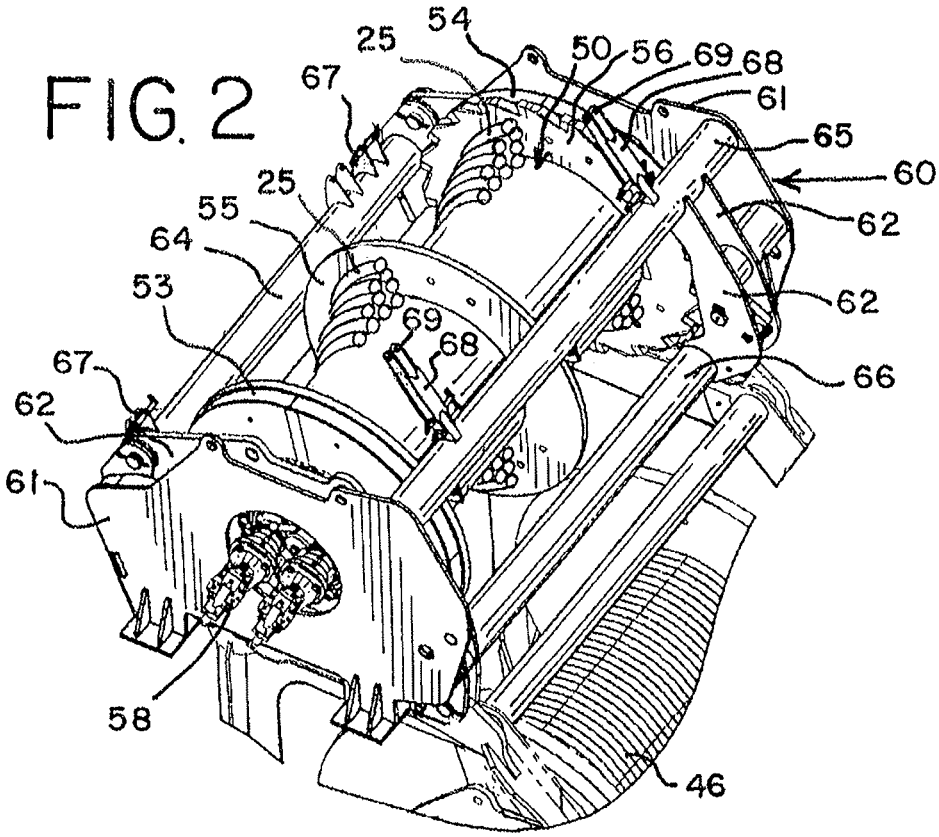
FIG. 2 is a perspective view of the boom hoist drum and frame of FIG. 1 without the equalizers attached. Only a portion of the boom hoist line is shown, for sake of clarity.
Figure 3:
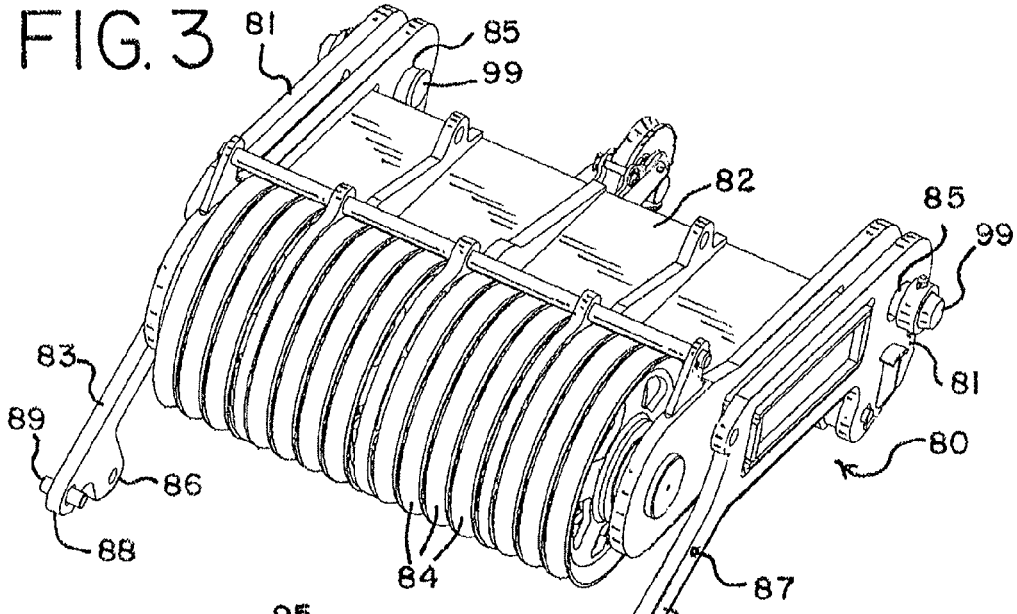
FIG. 3 is a perspective view of the upper equalizer used in the combination of FIG. 1.
Figure 4:
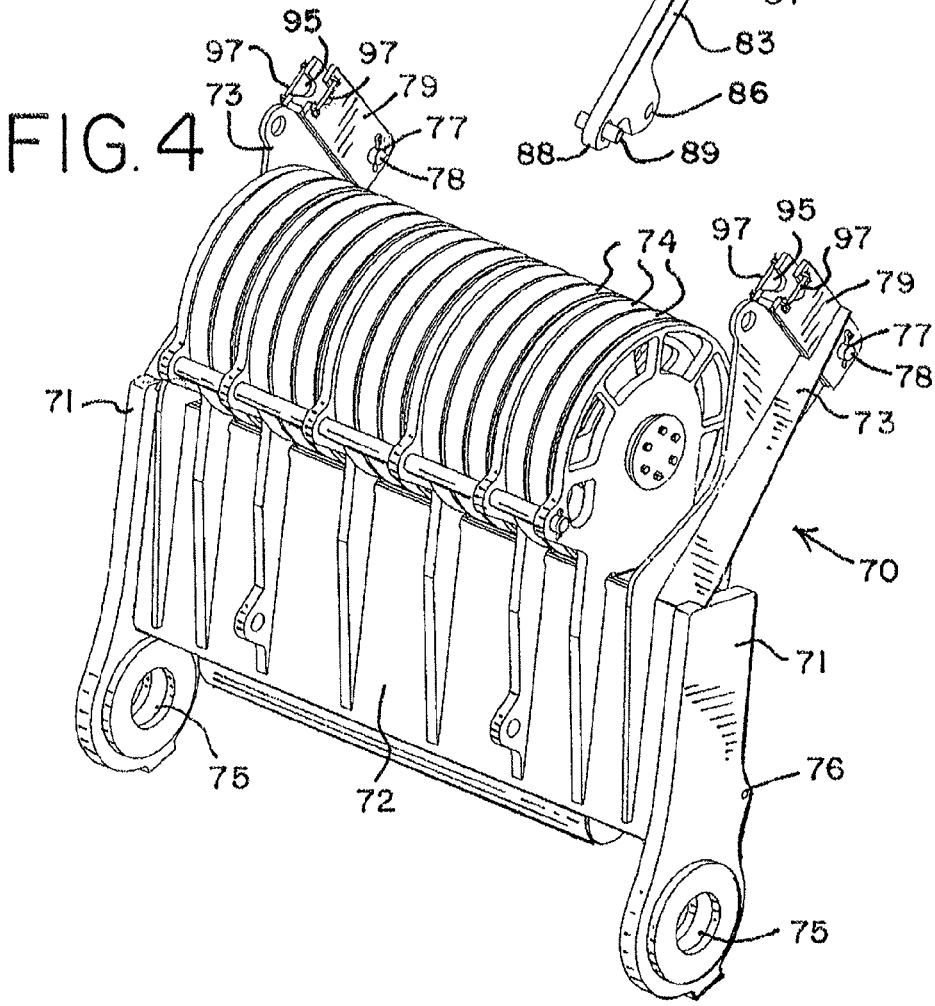
FIG. 4 is a perspective view of the lower equalizer used in the combination of FIG. 1.
Figure 5:
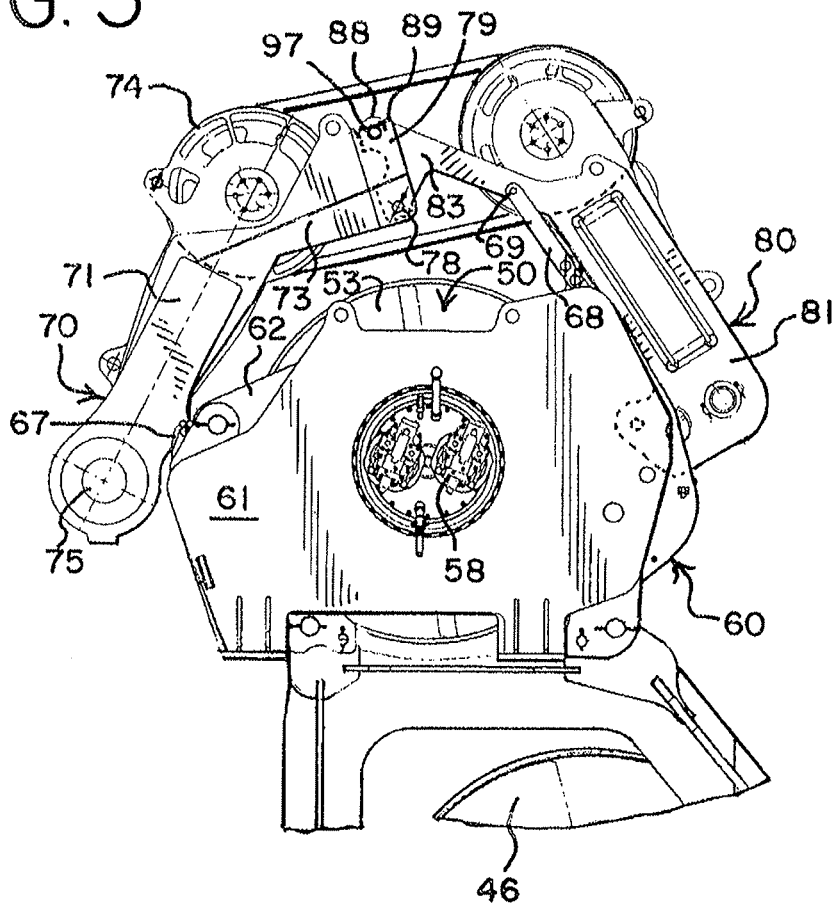
FIG. 5 is a side elevational view of the combined boom hoist drum, frame, lower equalizer and upper equalizer of FIG. 1, shown attached to the frame of a second drum.

The boom hoist drum 50 and frame 60 are best seen in FIG. 2. The upper equalizer 80 is best seen in FIG. 3. The lower equalizer 70 is best seen in FIG. 4. The combined boom hoist drum, frame and equalizers as they are first mounted to the rotating bed during crane set-up are shown in FIG. 5. In a preferred embodiment of the invention, the boom hoist drum frame is connected to the rotating bed by being connected to a frame of another drum that is in turn connected to the rotating bed. In FIGS. 2 and 5 the frame 60 is shown secured on top of the frame of a lower load hoist drum 46, which in turn is secured to the rotating bed 22. The wire rope 25 normally found wrapped on the drum 50 and reeved through the equalizers 70, 80 is not shown in FIGS. 3-4, and is shown only in part in FIGS. 1-2, for sake of clarity.

The boom hoist line 25 is preferably continuously reeved, with both ends of the line being tied off on the boom hoist drum 50. As with conventional boom hoist drums using continuous reeving, the drum 50 (FIG. 2) includes a main cylinder on which the rope 25 is wrapped, with ends 53 and 54, and a separator 55 in the center that separates the two ends of the line as they are wound on the drum. A ratchet and pawl 56 are included to lock the drum when needed. A drive assembly 58 on each end of the drum includes dual variable displacement hydraulic motors, and a spring-set, hydraulic-release brake (not shown).

The boom hoist drum frame 60 includes end plates 61, and a number of mounting plates 62 of various shapes spaced inwardly from the end plates 61. The frame is tied together with cross bars 63, 64, 65 and 66. The shapes and placement of the mounting plates 62 are dependent on the drive mechanism, brake and other components that are attached to them. These, and other features of the drum, will vary depending on the components used to make up the boom hoist drum, and are not crucial to the invention. However, to mount the equalizers on the frame 60 according to the present invention, the frame is provided with some additional mounting brackets. The cooperating attachment structures allowing the equalizers to be detachably connected to the frame 60 include holes on the frame and equalizers that are positioned such that they can be aligned with one another, and pins may be placed through the holes to pin the equalizers to the frame. The top rear cross bar 64 includes two sets of brackets 67 used to mount the lower equalizer 70. The top front cross bar 65 includes two links 68 that extend upwardly along the length of the bar 65, terminating in brackets 69 to which the upper equalizer 80 may be connected.

The lower equalizer 70 (FIG. 4) includes a plurality of sheaves 74 and can be disconnected from the rest of the crane but maintained as a self-contained structure where the plurality of sheaves all stay together. The lower equalizer has two side members 71 with a cross member 72 between them, and two side extensions 73. The cross member 72 supports the plurality of sheaves 74 on which the wire rope 25 is reeved (not shown in FIG. 4 for sake of clarity). The two side members 71 each having a first large hole 75 through which the lower equalizer 70 can be connected to the mast 28, and a second hole 76, smaller than the first hole 75, used to detachably connect the lower equalizer to the boom hoist drum frame 60. The side extensions 73 each include a hole 77 (shown with pin 78 through it in FIG. 4) whereby the lower equalizer 70 is pinned to the upper equalizer 80 during transportation between job sites (see FIG. 1). The hole 77 is preferable a double hole formed though both walls of a two walled member 79 attached to the end of the extension 73. The two walled member 79 also include a saddle 95.

The upper equalizer 80 (FIG. 3) also includes a plurality of sheaves 84 and can be disconnected from the rest of the crane but maintained as a self-contained structure where the plurality of sheaves all stay together. The upper equalizer has two side members 81 with a cross member 82 between them, and two side extensions 83. The cross member 82 supports the plurality of sheaves 84 on which the wire rope 25 is reeved (not shown in FIG. 3 for sake of clarity). The two side members 81 each have a first large hole 85 through which the upper equalizer 80 can be connected to another component of a mobile lift crane, such as by pins 99, which can connect the upper equalizer to the fixed length pendants 21. The side extensions 83 each include a first hole 86 whereby the upper equalizer is pinned to the lower equalizer 70 during transportation between job sites using pin 78, and a second hole 87 used to detachably connect the upper equalizer to the boom hoist drum frame 60. The extensions 83 each terminate in a protrusion 88 that has a pin 89 captured in it. This pin 89 sits in saddle 95 when the upper equalizer is connected to the lower equalizer in the transport configuration. Pins 97 are put in place through holes in brackets on the sides of the two walled member 79 over pin 89 to keep pin 89 in the saddle 95 for transport, as best seen in FIG. 1.

By the use of holes 87, the upper equalizer 80 is detachably connected by being pinned to the boom hoist drum frame 60; and by the use of holes 76, the lower equalizer is detachably connected by being pinned to the boom hoist drum frame 60. By the use of holes 77 and 86 and pin 78, and the saddle 95 and pin 89, and pins 97, the upper and lower equalizers are connected to one another, in addition to their connections to the boom hoist drum frame.

Figure 6:
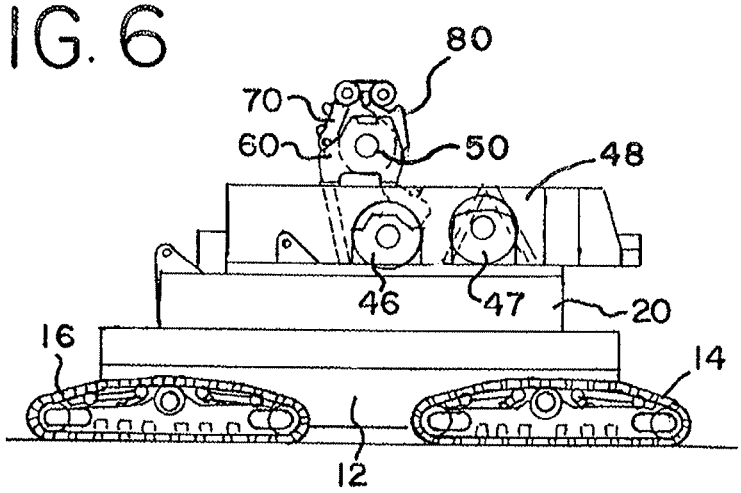
FIG. 6 is a side elevational view of the combined boom hoist drum, frame, lower equalizer and upper equalizer of FIG. 1 installed on a rotating bed during a crane set-up operation.

FIGS. 6-19 will now be described in conjunction with a method of setting up mobile lift crane 10 using the present invention. As shown in FIG. 6, first the carbody 12 is provided with moveable ground engaging members, in this case crawlers 14 and 16. Next a rotating bed 20 is rotatably connected to the carbody 12 such that the rotating bed can swing with respect to the ground engaging members 14, 16. This combined carbody and rotating bed will typically require several transport trailers to convey the parts to the job site. Application Ser. No. 61/099,098 (filed Sep. 22, 2008) shows one preferred method of transporting and connecting the parts used to make the carbody and crawler combination. Other parts may be installed on the rotating bed, such as the lower load hoist drum 46 and a whip hoist drum 47, and a power unit 48.

Next the combination of the boom hoist drum 50 secured to frame 60, with lower equalizer 70 and upper equalizer 80 pinned to the frame 60, and boom hoist line 25 wound on the drum 50 and reeved through the sheaves 74 and 84 on the equalizers, as seen in FIG. 1, is hoisted into place. The combined boom hoist drum, frame and equalizers are attached to the rotating bed 20 by securing frame 60 to the frame on the lower load hoist drum 46. Hydraulic lines from the power unit are connected to the drive assembly 58 on each end of the drum 50, as well as to the other drums on the rotating bed.

Figure 7:
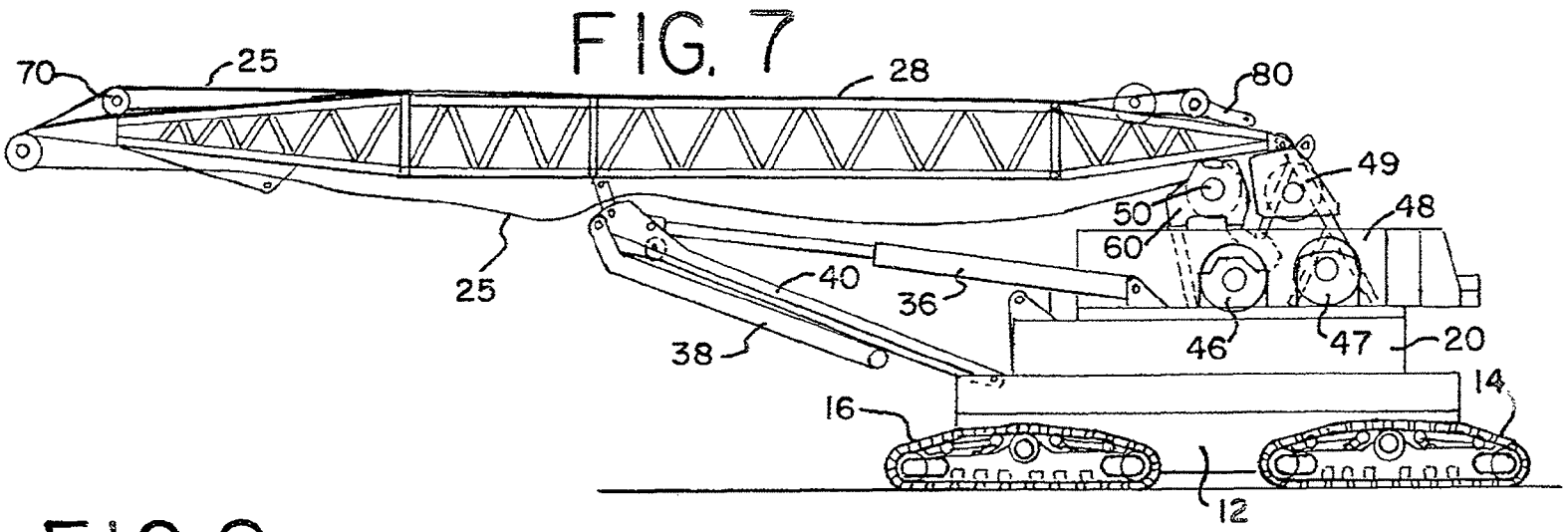
FIG. 7 is a side elevational view of the crane components as assembled in FIG. 6 with the equalizers repositioned, and a mast, counterweight movement structure and an upper load hoist drum added.
Figure 9:
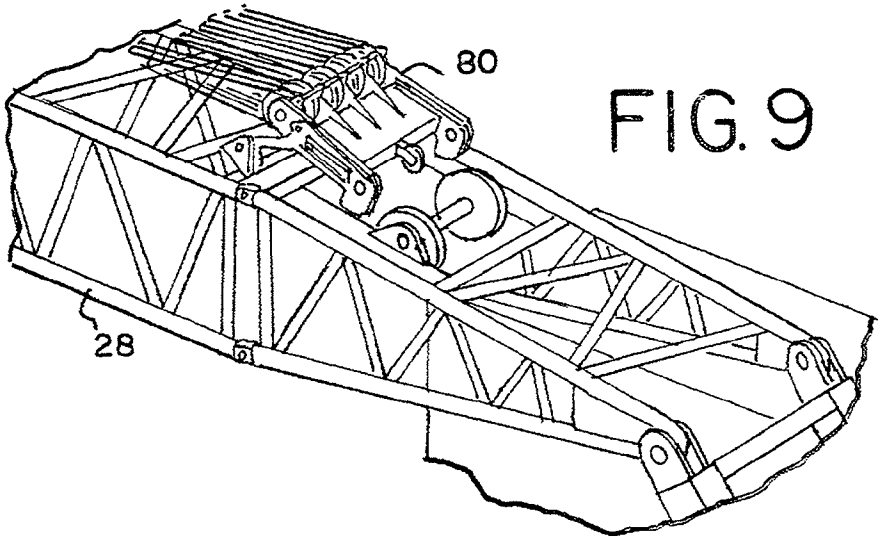
FIG. 9 is an enlarged perspective view of the bottom portion of the mast of FIG. 7.
Figure 8:
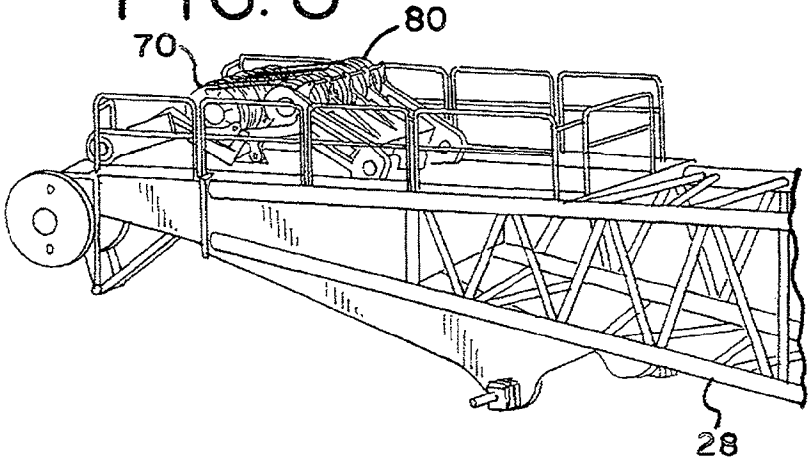
FIG. 8 is an enlarged perspective view of the top of the mast at an intermediate installation step between that seen in FIG. 6 and FIG. 7.

Leading up to what is shown in FIG. 7, several steps take place. First, the variable position counterweight movement structure, including liner actuation device 36, arm 38 and pivot frame 40, are installed on the rotating bed. Next the upper and lower equalizers are disconnected from the boom hoist drum frame 60 while leaving the boom hoist line reeved between the pluralities of sheaves 74 and 84. The pins 78 and 97 may be left in place to leave the equalizers connected to one another. As an assist crane lifts the equalizers, boom hoist wire rope 25 is paid out. The equalizers are placed at a convenient point on the ground adjacent to the crane. The upper load hoist drum 49 is then hoisted into place and connected to the rotating bed through the frame of the whip hoist drum 47. The mast 28 is assembled on the ground and lifted into position with the assist crane, and its lower end is pinned to the rotating bed by connected to the frame of the upper load hoist drum 49. A hydraulic cylinder (not shown) raises the linear actuation device 36 until it engages the mast to hold it up. The assist crane then positions the upper and lower equalizers at the mast top, as shown in FIG. 8. Boom hoist rope 25 is paid off the boom hoist drum as necessary. The installation of the lower equalizer on the mast top effectively connects the lower equalizer 70 to the rotating bed 20. Next the upper equalizer 80 is separated and the assist crane pulls the upper equalizer to the mast butt. It is then pinned into a temporary position, as shown in FIG. 9; again paying out boom hoist line 25 as necessary. This leaves the crane in the position shown in FIG. 7.

Figure 10:
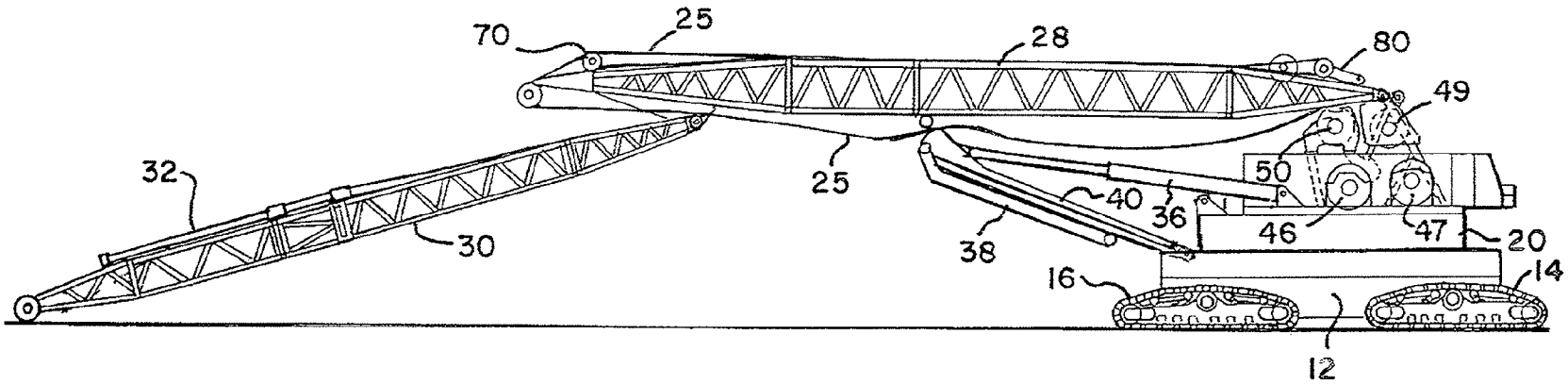
FIG. 10 is a side elevational view of the crane components as assembled in FIG. 7 with a backhitch and counterweight tension member added.
Figure 11:
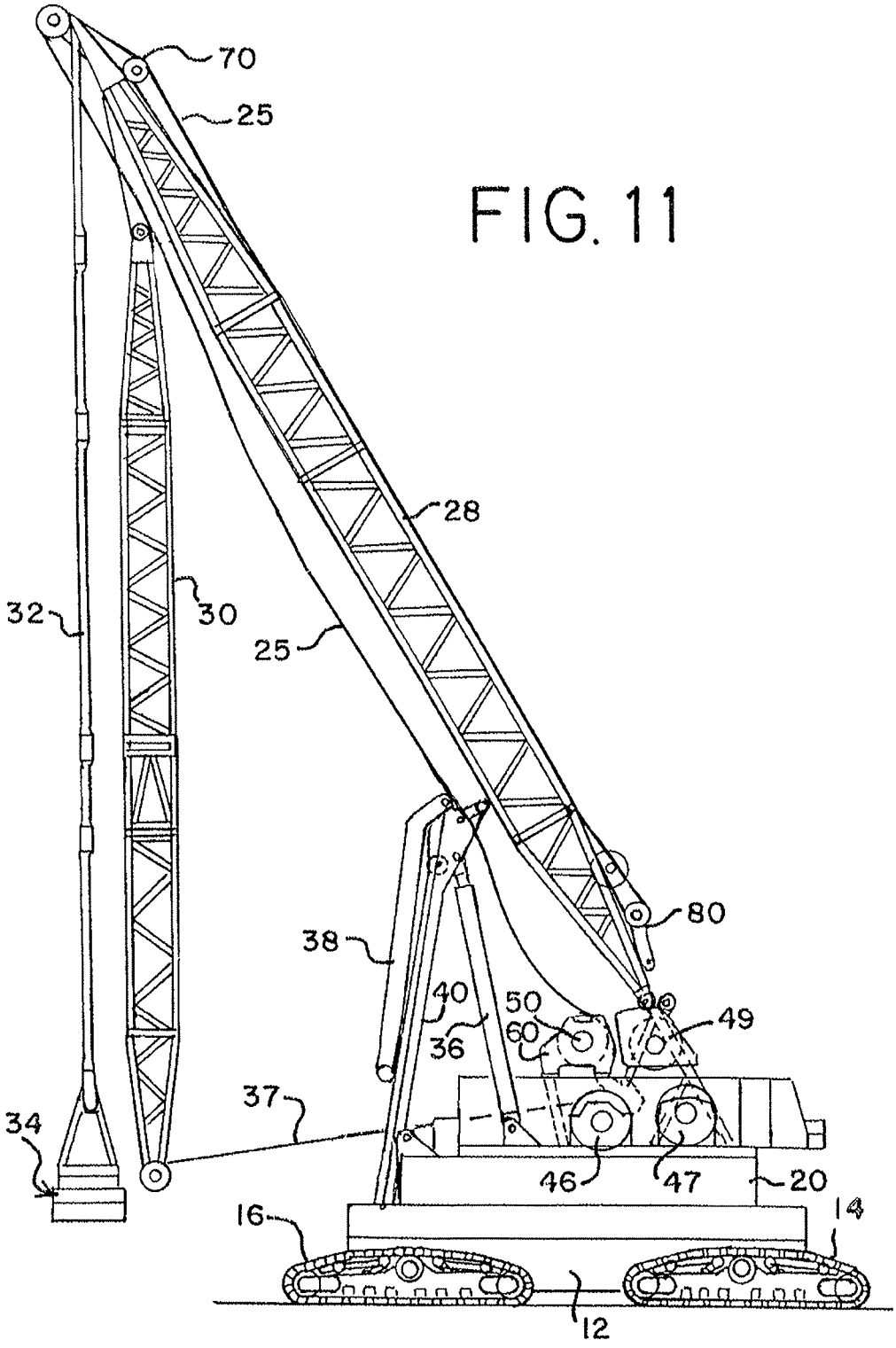
FIG. 11 is a side elevational view of the crane components as assembled in FIG. 10 with a counterweight tray added.
Figure 12:
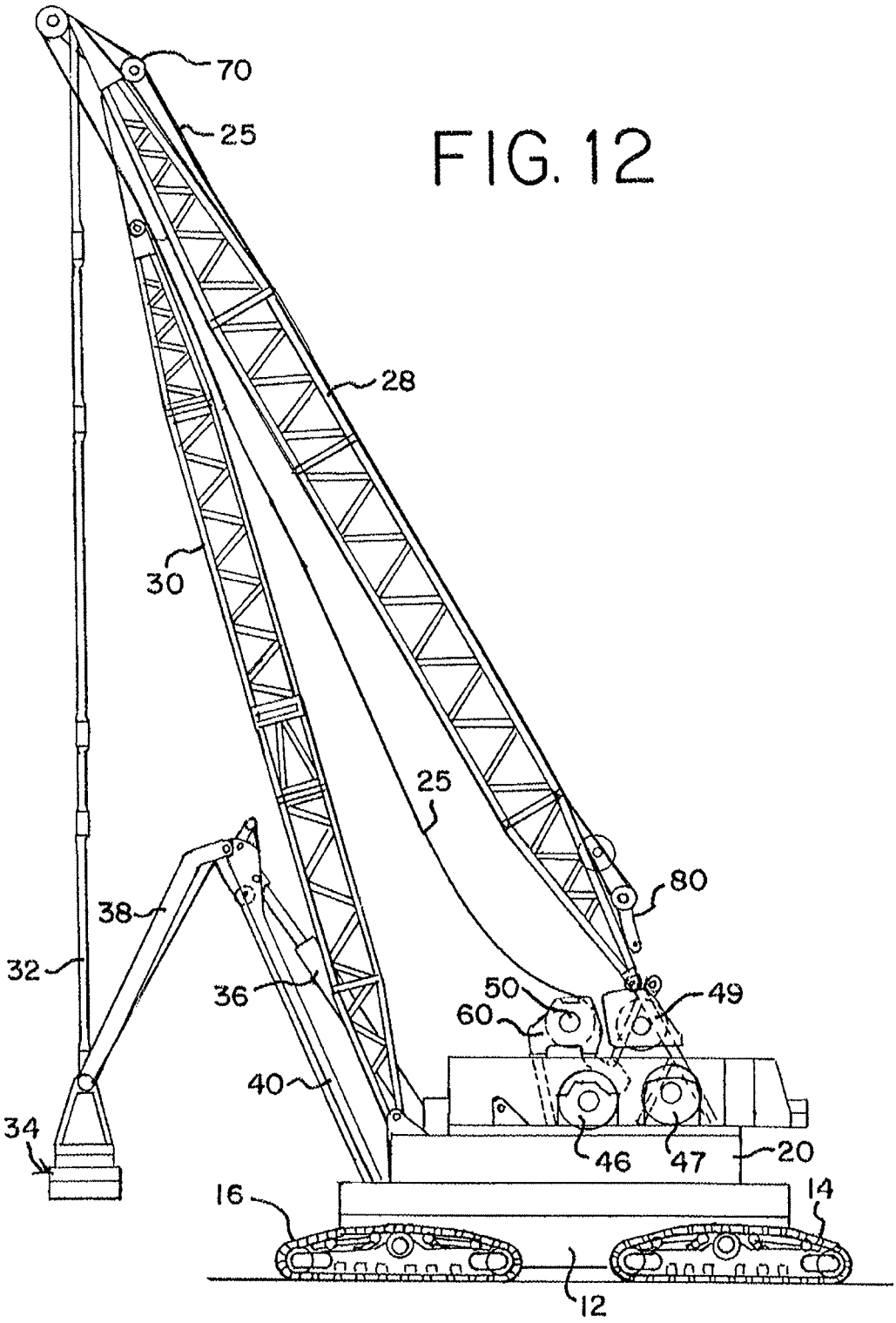
FIG. 12 is a side elevational view of the crane components as assembled in FIG. 11 with the counterweight movement structure connected to the counterweight.

Next the backhitch 30 is assembled and raised into position, and pinned adjacent the mast top, as shown in FIG. 10. The tension member 32 is connected adjacent the top of the mast. A roll up wheel may be used on the end of the backhitch while it is then moved into the positions shown in FIG. 11 by retracting the linear actuation device 36, which raises the mast. The counterweight tray used in counterweight unit 34 is then attached to the tension member 32. A tugger winch rope 37 is temporarily attached to the free end of the backhitch 30 so that it can be pulled into position and connected to the rotating bed 20, as shown in FIG. 12. After the backhitch is in position, the linear actuation device 36 can be disconnected from the mast so that the arm 38 can be extend out to connect to the counterweight tray.

Figure 13:
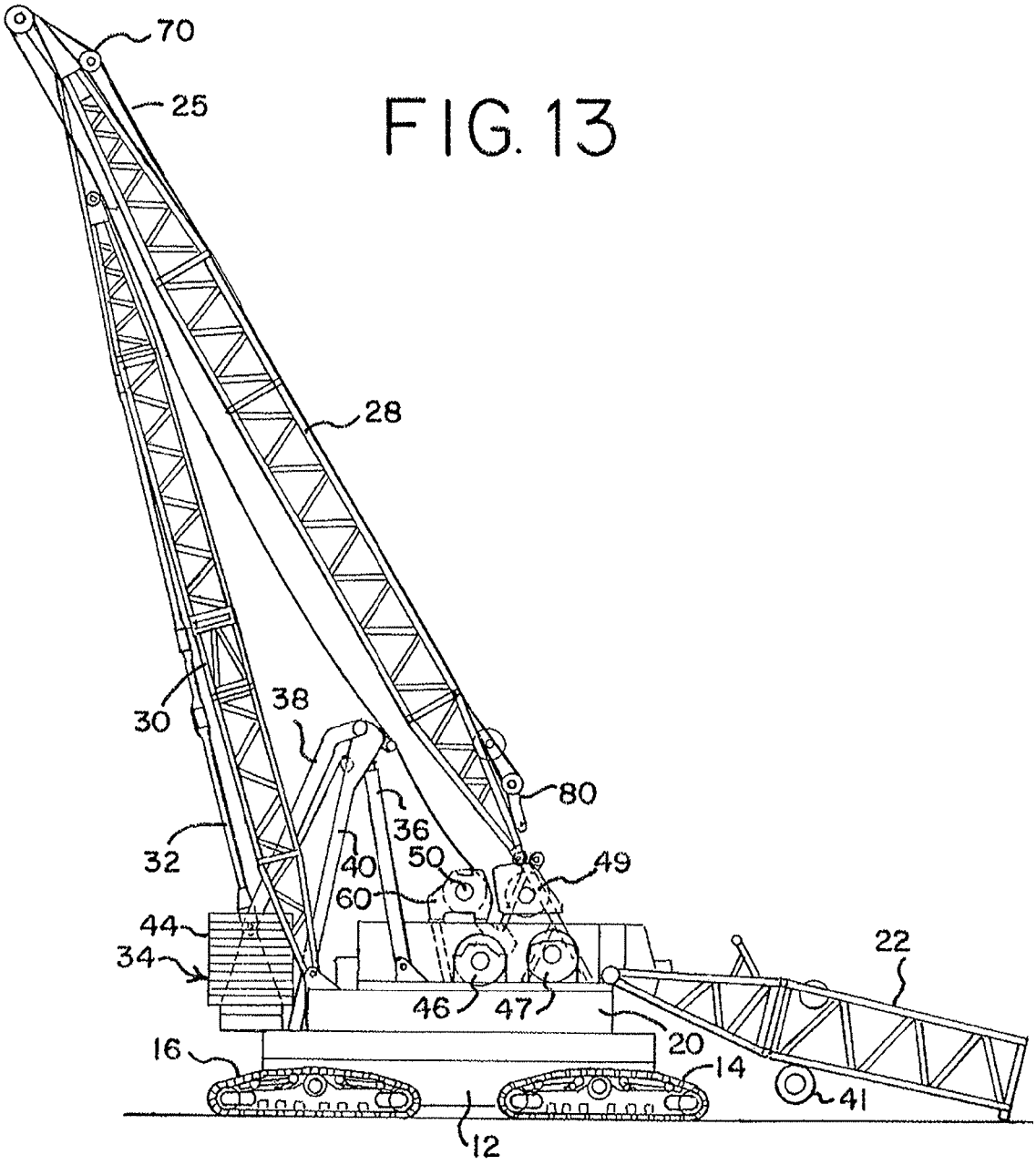
FIG. 13 is a side elevational view of the crane components as assembled in FIG. 12 with a boom butt added.

The counterweight unit can then be pulled back toward the rotating bed 20, as shown in FIG. 13, and the counterweight boxes 44 stacked on the tray. Next the boom 22 is pivotally connected to the rotating bed. This begins with off-loading and staging the boom butt and the first boom segment and pinning them together. They are lifted over the luffing jib drum 41, which is pinned onto the boom segment. This entire arrangement is then assembled into the boom hinge on the rotating bed and pinned, as shown in FIG. 13. (In an alternate embodiment (not shown), the luffing jib drum 41 is placed on the front roller carrier portion of the rotating bed, rather than near the bottom of the boom.)

Figures 14, 15:
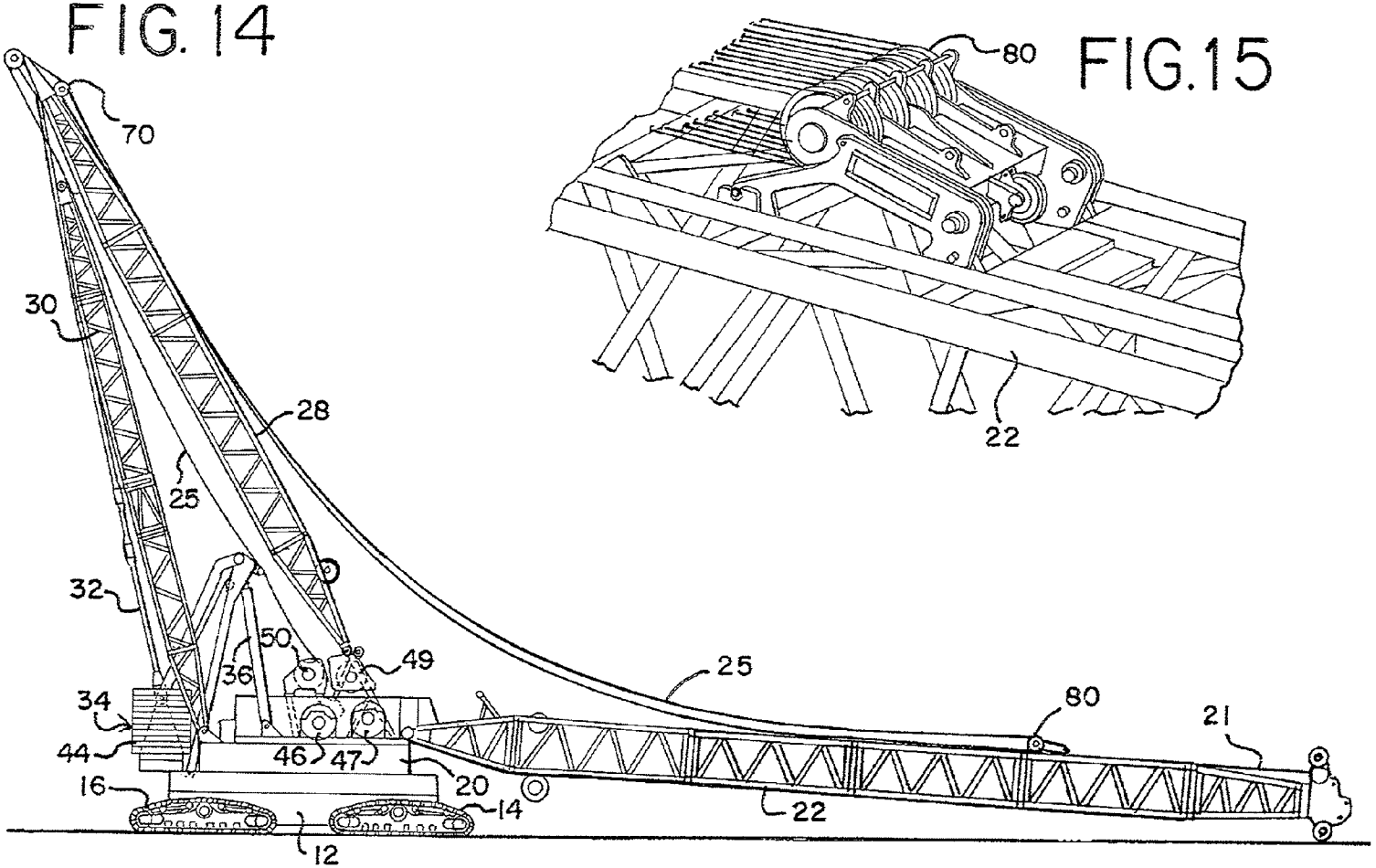
FIG. 14 is a side elevational view of the crane components as assembled in FIG. 13 with additional boom sections added and the upper equalizer repositioned.
FIG. 15 is an enlarged perspective view of a boom section with the upper equalizer attached as in FIG. 14.

Additional boom segments and the boom top are added to reach the desired boom length. The luffing jib backstay straps and the fixed length pendants 21 are connected to the boom top. With the upper equalizer 80 pinned to the mast butt (FIG. 13), a rigging winch line is pulled out, placed around the boom top, and attached to the upper equalizer 80. The assist crane is also attached to the upper equalizer. The upper equalizer is unpinned from the mast butt and supported by the assist crane. Boom hoist rope 25 is paid out as the rigging winch line is paid in. The assist crane follows along, providing vertical support of the upper equalizer. The upper equalizer is brought into place and pinned temporarily to the boom, as shown in FIGS. 14 and 15. The fixed length pendants 21 can then be connected to the upper equalizer, thus connecting the upper equalizer to the boom top.

Figure 16:
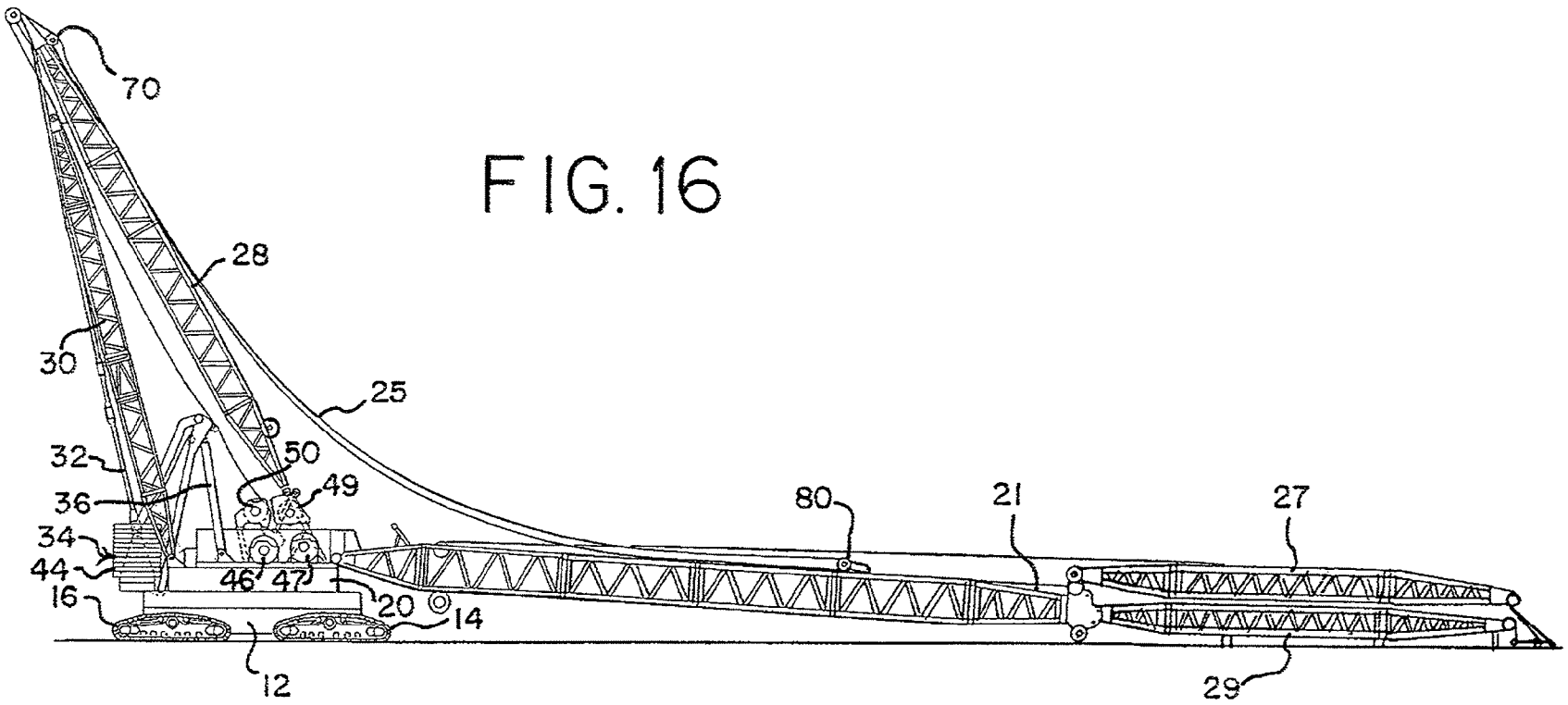
FIG. 16 is a side elevational view of the crane components as assembled in FIG. 15 with luffing jib struts added.
Figure 17:
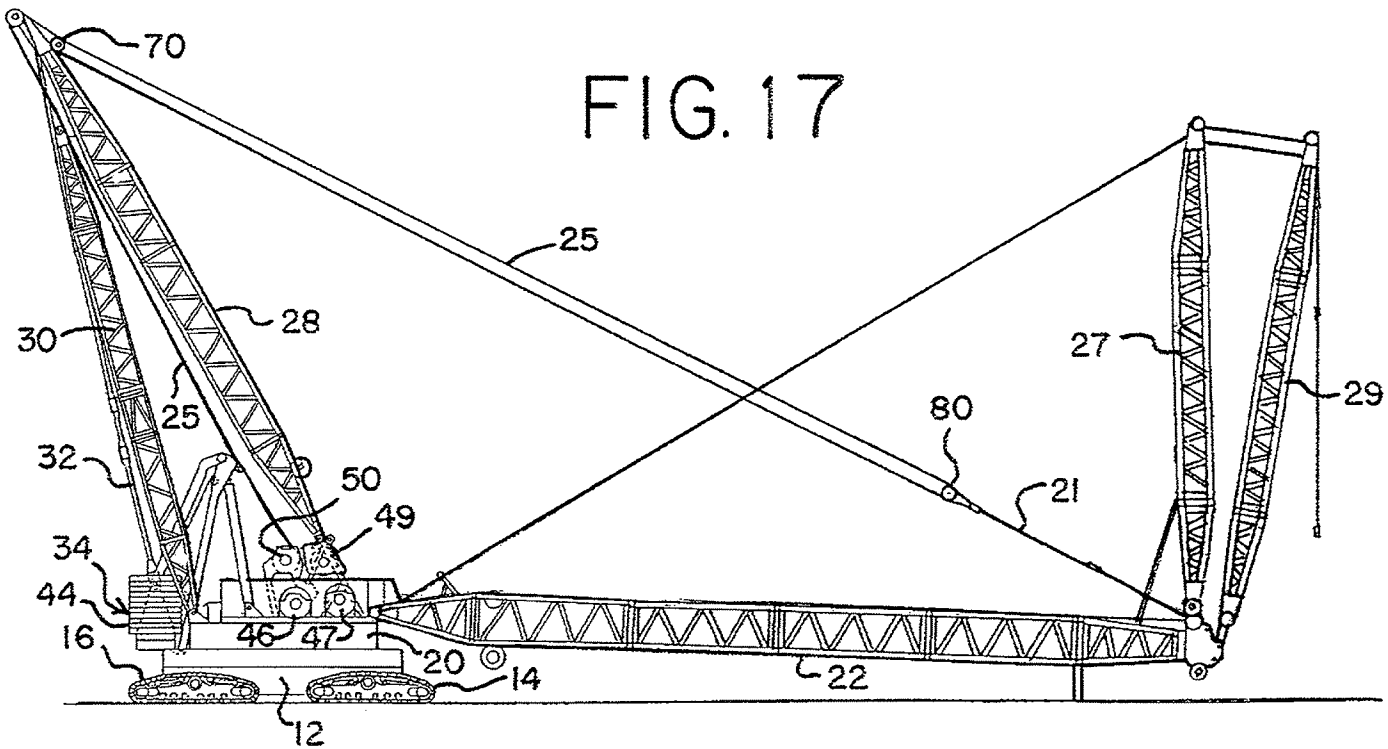
FIG. 17 is a side elevational view of the crane components as assembled in FIG. 16 with the fixed length pendants attached between the boom top and the upper equalizer, and with the luffing jib struts raised.
Figure 18:
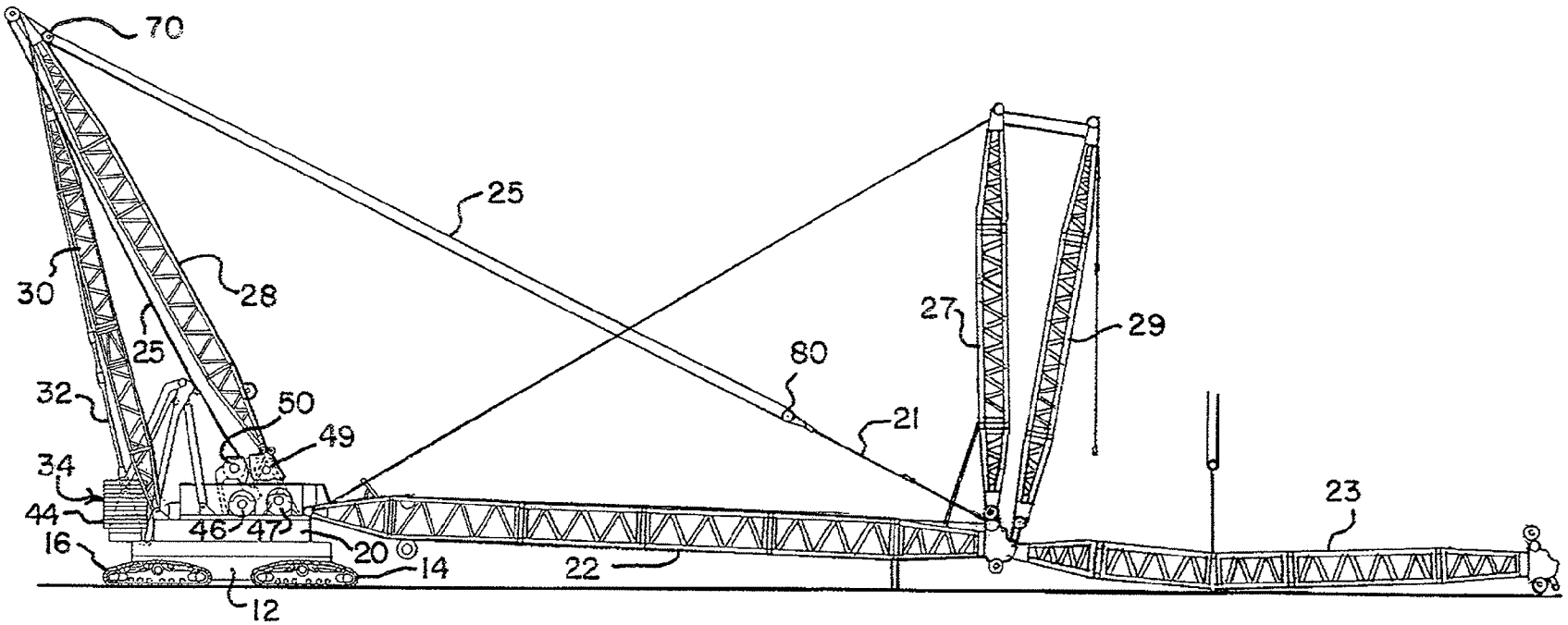
FIG. 18 is a side elevational view of the crane components as assembled in FIG. 17 with luffing jib components added.
Figure 19:
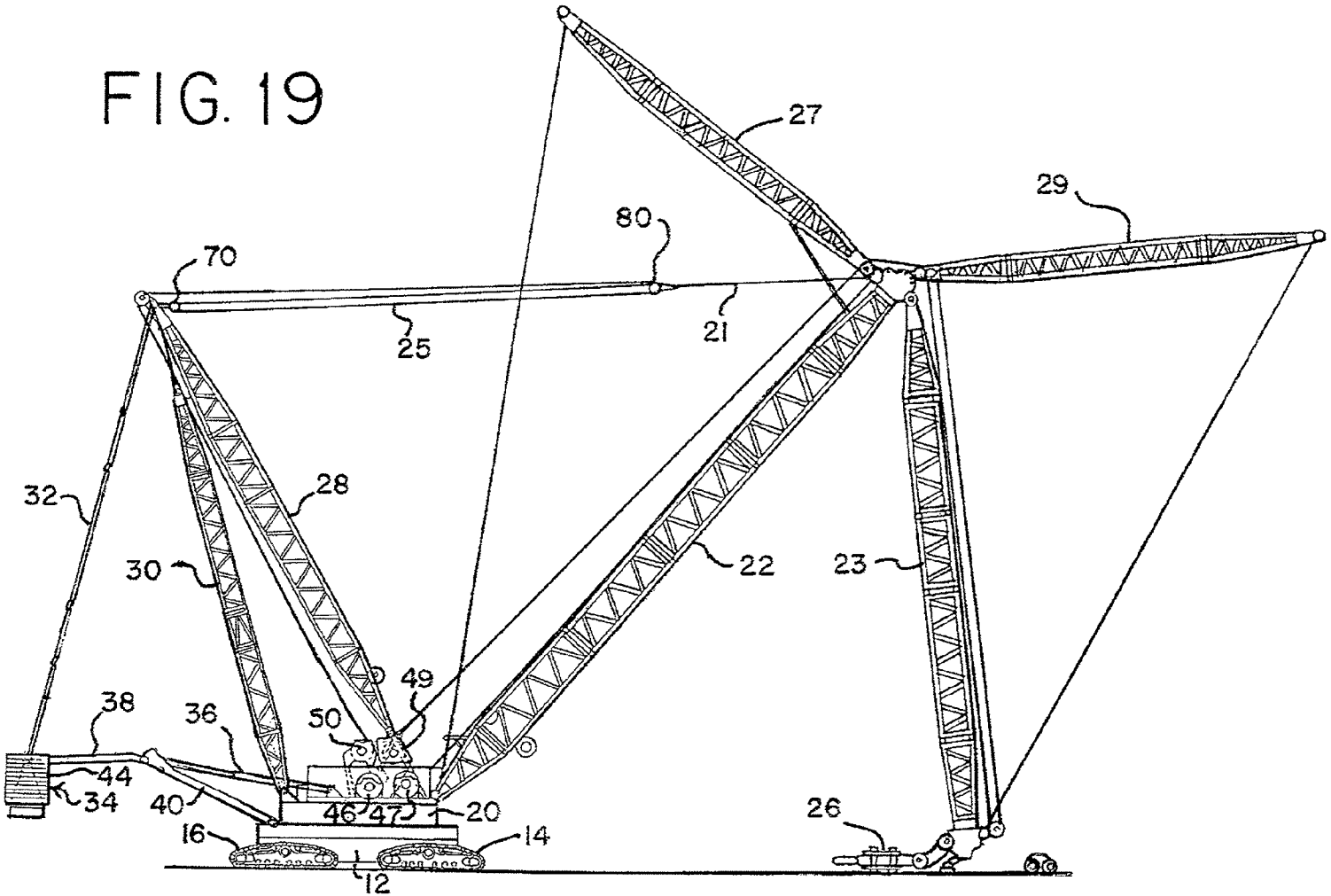
FIG. 19 is a side elevational view of the crane components as assembled in FIG. 18 with the luffing jib completed and the boom partially raised.

The first and second jib struts 27 and 29, as well as associated luffing jib rigging, are installed next, as shown in FIG. 16. The whip line from the whip line hoist 47 may be used pull the first jib strut over center while it is raised with the assist crane to the point that the backstay suspension can be pinned. The upper equalizer is unpinned from the boom, and the boom hoist rigging and the luffing jib rigging are then used to raise the boom and the first and second struts to the position shown in FIG. 17. The luffing jib 23 is next assembled, as shown in FIG. 18. The load hoist line 24 and second load hoist line are pulled out. The whip line is pulled out as needed as well. The second jib strut is lowered so that the second strut can be pinned with a fixed length pendant to the top of the luffing jib. The boom hoist rope is pulled in, raising the boom 22 and jack knifing the luffing jib 23, to the position shown in FIG. 19. The hook block 26 can then be reeved, along with the sheave set at the top of the luffing jib with the load hoist lines. In a preferred embodiment both load hoist lines are connected to an equalizing mechanism in the hook block so that both drums 46 and 49 can be used together to hoist a load. The boom hoist drum 50 is used to pull in more wire rope 25, the luffing jib rigging is also pulled in, and the crane 10 is boomed up into a working position, as shown in FIG. 20.

The invention also involves a method of disassembling and transporting a mobile lift crane. The invention is used when taking the crane down after working at a job site, so that it can be transported to a second job site. The reverse of the steps used above and explained with respect to FIGS. 6-20 may be used. In that case, some of the essential steps are: disconnecting the fixed length pendants from between the boom top and the upper equalizer; b) disconnecting the lower equalizer from the rotating bed; c) disconnecting the boom hoist drum frame from the rotating bed; d) leaving the boom hoist line reeved between the lower equalizer and the upper equalizer and wound on the boom hoist drum; e) connecting the upper equalizer to the boom hoist drum frame or connecting the lower equalizer to the boom hoist drum frame, and preferably connecting both the lower equalizer and upper equalizer to the boom hoist drum frame, to form a combined transport assembly, and f) transporting the boom hoist drum, boom hoist drum frame, lower equalizer, upper equalizer and boom hoist line together on a single transport trailer between job sites. The step of disconnecting the lower equalizer from the rotating bed will, in the preferred embodiment, involve disconnecting the lower equalizer from the mast. In the preferred embodiment, the fixed length pendants 21 comprise multiple straps, each the same length as a boom segment used in the boom 22, and the step of disconnecting the fixed length pendants comprises disconnecting the straps from both the boom and the upper equalizer. When the straps are being disconnected from the boom, the section of strap connected to the boom top is often left attached to the boom top.

Preferably the step of connecting the lower equalizer to the boom hoist drum frame takes place before the step of disconnecting the boom hoist drum frame from the rotating bed. As with the set up operation, in a preferred embodiment, the upper equalizer is temporarily connected adjacent the second end of the mast between the step of disconnecting the fixed length pendants from between the boom top and the upper equalizer, and the step of connecting the lower equalizer to the boom hoist drum frame. Also, preferably the step of connecting the lower equalizer and upper equalizer to the boom hoist drum frame to form a combined transport assembly comprises pinning the lower equalizer and upper equalizer to the frame, as discussed above.

It should be understood that various changes and modifications to the presently preferred embodiments described herein will be apparent to those skilled in the art. For example, the upper equalizer may not need to be pinned to the boom when it is disconnected from the mast butt and moved over to the boom. Instead, the straps may be connected, and provide enough force to keep the upper equalizer and the boom hoist rigging pulled taught. Also, the crane may use a live mast, with the upper equalizer being connected to the mast and the lower equalizer being connected to the rotating bed or a gantry on the rotating bed. Some of the steps described above in setting up the crane may be carried out in different orders. For example, the boom may be attached to the rotating bed before the first and second equalizers are taken off from the boom hoist drum frame. Such changes and modifications can be made without departing from the spirit and scope of the present invention and without diminishing its intended advantages. It is therefore intended that such changes and modifications be covered by the appended claims.

The invention claimed is:

1. A method of disassembling and transporting a mobile lift crane, the lift crane comprising, prior to disassembly, i) a rotating bed, ii) a boom pivotally mounted on the rotating bed, iii) a boom hoist drum mounted in a frame, the frame being connected to the rotating bed, iv) a lower equalizer connected to the rotating bed, v) an upper equalizer, vi) fixed length pendants connected between the upper equalizer and the boom top, vii) a boom hoist line wound on the boom hoist drum and reeved through the lower equalizer and the upper equalizer such that rotation of the boom hoist drum changes the amount of boom hoist line between the lower equalizer and the upper equalizer, thereby changing the angle between the rotating bed and the boom, and viii) a mast mounted at a first end to the rotating bed and having a second opposite end, with the lower equalizer being connected to the rotating bed by being connected to the mast adjacent the second end of the mast; the method comprising:

a) disconnecting the fixed length pendants from between the boom top and the upper equalizer;

b) disconnecting the lower equalizer from the rotating bed by disconnecting the lower equalizer from the mast;

c) disconnecting the boom hoist drum frame from the rotating bed;

d) leaving the boom hoist line reeved between the lower equalizer and the upper equalizer and wound on the boom hoist drum;

e) connecting the lower equalizer to the boom hoist drum frame; and f) transporting the boom hoist drum, boom hoist drum frame, lower equalizer, upper equalizer and boom hoist line together on a single transport trailer between one job site and another.

2. The method of claim 1 further comprising the step of connecting the upper equalizer to the boom hoist drum frame.

3. The method of claim 1 wherein the upper and lower equalizers are pinned to the boom hoist drum frame during transport between job sites.

4. The method of claim 1 wherein the fixed length pendants comprise straps, and the step of disconnecting the fixed length pendants comprises disconnecting the straps from both the boom and the upper equalizer.

5. The method of claim 1 wherein the step of connecting the lower equalizer to the boom hoist drum frame takes place before the step of disconnecting the boom hoist drum frame from the rotating bed.

6. The method of claim 1 wherein the upper equalizer is temporarily connected adjacent the second end of the mast between the step of disconnecting the fixed length pendants from between the boom top and the upper equalizer and the step of connecting the lower equalizer to the boom hoist drum frame.

7. A method of disassembling a mobile lift crane, the lift crane comprising, prior to disassembly, i) a rotating bed, ii) a boom pivotally mounted on the rotating bed, iii) a boom hoist drum mounted in a frame, the frame being connected to the rotating bed, iv) a lower equalizer connected to the rotating bed, v) an upper equalizer, vi) fixed length pendants connected between the upper equalizer and the boom top, vii) a boom hoist line wound on the boom hoist drum and reeved through the lower equalizer and the upper equalizer such that rotation of the boom hoist drum changes the amount of boom hoist line between the lower equalizer and the upper equalizer, thereby changing the angle between the rotating bed and the boom, and viii) a mast mounted at a first end to the rotating bed and having a second opposite end, with the lower equalizer being connected to the rotating bed by being connected to the mast adjacent the second end of the mast; the method comprising:

a) disconnecting the fixed length pendants from between the boom top and the upper equalizer;
b) disconnecting the lower equalizer from the rotating bed by disconnecting the lower equalizer from the mast;
c) disconnecting the boom hoist drum frame from the rotating bed;
d) leaving the boom hoist line reeved between the lower equalizer and the upper equalizer and wound on the boom hoist drum; and
e) connecting the lower equalizer and upper equalizer to the boom hoist drum frame to form a combined transport assembly.

8. The method of claim 7 wherein the step of connecting the lower equalizer and upper equalizer to the boom hoist drum frame to form a combined transport assembly comprises pinning the lower equalizer and upper equalizer to the frame.

9. A combination of a boom hoist drum secured to a frame, a first equalizer having a plurality of sheaves, a second equalizer having a plurality of sheaves, and a boom hoist line, wherein the first equalizer is detachably connected directly to the boom hoist drum frame, the second equalizer is also detachably connected directly to the boom hoist drum frame and the first and second equalizers are connected to one another in addition to their connections to the boom hoist drum frame, and the boom hoist line is wound on the boom hoist drum and reeved between the sheaves of the first and second equalizers, and wherein the first and second equalizer each comprise two side members with a cross member between them, the cross member supporting the plurality of sheaves; and wherein the first equalizer further comprises two side extensions, and the two side members each have a first large hole through which the first equalizer can be connected to another component of a mobile lift crane and a second hole, smaller than the first hole, used to detachably connect the first equalizer to the boom hoist drum frame, and the side extensions each include a hole whereby the first equalizer is pinned to the second equalizer.

10. The combination of claim 9 wherein the first equalizer is detachably connected by being pinned to the boom hoist drum frame and the second equalizer is detachably connected by being pinned to the boom hoist drum frame.

11. The combination of claim 9 wherein the second equalizer further comprises two side extensions, and the two side members each have a first large hole through which the second equalizer can be connected to another component of a mobile lift crane, and the side extensions each include a first hole whereby the first equalizer is pinned to the second equalizer, and a second hole used to detachably connect the second equalizer to the boom hoist drum frame.

12. A mobile lift crane comprising:

a) a carbody having moveable ground engaging members;
b) a rotating bed rotatably connected to the carbody such that the rotating bed can swing with respect to the ground engaging members;
c) a boom pivotally mounted on the rotating bed;
d) a load hoist line trained over a pulley on the boom and wound on a load hoist drum connected to the rotating bed;
e) a boom hoist drum mounted in a frame, the frame being connected to the rotating bed;
f) a boom hoist line wound on the boom hoist drum and connected to an upper equalizer and a lower equalizer, with the upper equalizer connected to the top of the boom by fixed length pendants, such that rotation of the boom hoist drum changes the amount of boom hoist line between the lower equalizer and the upper equalizer, thereby changing the angle between the rotating bed and the boom; and
g) a mast mounted at a first end to the rotating bed and having a second opposite end, with the lower equalizer connected to the mast adjacent the second end of the mast in an operational configuration, wherein the connection of the lower equalizer to the mast is detachable for transport of the crane;
h) wherein the upper and lower equalizer each comprise two side members with a cross member between them, the cross member supporting a plurality of sheaves; and wherein the boom hoist drum frame, the lower equalizer and the upper equalizer each including cooperating attachment structures whereby the lower and upper equalizers can be detachably connected to the frame so that the boom hoist drum, the lower equalizer, the upper equalizer and the boom hoist line can be transported as a combined assembly.

13. The mobile lift crane of claim 12 wherein the cooperating attachment structures comprise holes on the frame and equalizers that are positioned such that they can be aligned with one another and pins may be placed through the holes to pin the equalizers to the frame.

14. The mobile lift crane of claim 12 wherein the boom hoist drum frame is connected to the rotating bed by being connected to a frame of another drum that is in turn connected to the rotating bed.

15. A method of setting up a mobile lift crane, comprising:

a) providing a carbody having moveable ground engaging members, and a rotating bed rotatably connected to the carbody such that the rotating bed can swing with respect to the ground engaging members;
b) providing a combination of a boom hoist drum secured to a frame, a first equalizer having a plurality of sheaves, a second equalizer having a plurality of sheaves, and a boom hoist line, wherein the first equalizer is detachably connected to the boom hoist drum frame, the second equalizer is also detachably connected to the boom hoist drum frame, and the boom hoist line is wound on the boom hoist drum and reeved between the sheaves of the first and second equalizers;

c) connecting the combined boom hoist drum, frame and equalizers to the rotating bed;

d) disconnecting the first and second equalizers from the boom hoist drum frame while leaving the boom hoist drum frame connected to the rotating bed and the boom hoist line reeved between the pluralities of sheaves;

e) connecting the first equalizer to the rotating bed;

f) pivotally connecting a boom having a boom top to the rotating bed; and g) connecting the second equalizer to the boom top with fixed length pendants.

16. The method of claim 15 further including the step of connecting a mast to the rotating bed, and the step of connecting the first equalizer to the rotating bed involves connecting the first equalizer to the mast.

17. A method of disassembling and transporting a mobile lift crane, the lift crane comprising, prior to disassembly, i) a rotating bed, ii) a boom pivotally mounted on the rotating bed, iii) a boom hoist drum mounted in a frame, the frame being connected to the rotating bed, iv) a lower equalizer connected to the rotating bed, v) an upper equalizer, vi) fixed length pendants connected between the upper equalizer and the boom top, and vii) a boom hoist line wound on the boom hoist drum and reeved through the lower equalizer and the upper equalizer such that rotation of the boom hoist drum changes the amount of boom hoist line between the lower equalizer and the upper equalizer, thereby changing the angle between the rotating bed and the boom; the method comprising:

a) disconnecting the fixed length pendants from between the boom top and the upper equalizer;

b) disconnecting the lower equalizer from the rotating bed;

c) disconnecting the boom hoist drum frame from the rotating bed;

d) leaving the boom hoist line reeved between the lower equalizer and the upper equalizer and wound on the boom hoist drum;

e) connecting the lower equalizer to the boom hoist drum frame, this connecting step occurring before the step of disconnecting the boom hoist drum frame from the rotating bed; and f) transporting the boom hoist drum, boom hoist drum frame, lower equalizer, upper equalizer and boom hoist line together on a single transport trailer between one job site and another.

18. A combination of a boom hoist drum secured to a frame, a first equalizer having a plurality of sheaves, a second equalizer having a plurality of sheaves, and a boom hoist line, wherein the first equalizer is detachably connected to the boom hoist drum frame, the second equalizer is also detachably connected to the boom hoist drum frame, and the boom hoist line is wound on the boom hoist drum and reeved between the sheaves of the first and second equalizers; wherein the first equalizer comprises two side members with a cross member between them and two side extensions, the cross member supporting the plurality of sheaves, and the two side members each having a first large hole through which the first equalizer can be connected to another component of a mobile lift crane and a second hole, smaller than the first hole, used to detachably connect the first equalizer to the boom hoist drum frame.

* * * * *